US006571988B2

(12) United States Patent
Bowen

(10) Patent No.: US 6,571,988 B2
(45) Date of Patent: Jun. 3, 2003

(54) ARTICLE RELEASE MECHANISM FOR A VENDING MACHINE

(75) Inventor: Daniel J. Bowen, Aiken, SC (US)

(73) Assignee: Maytag Corporation, Newton, IA (US)

( * ) Notice: Subject to any disclaimer, the term of this patent is extended or adjusted under 35 U.S.C. 154(b) by 69 days.

(21) Appl. No.: 09/866,670

(22) Filed: May 30, 2001

(65) Prior Publication Data

US 2002/0190077 A1 Dec. 19, 2002

(51) Int. Cl.[7] ..... G07F 11/00
(52) U.S. Cl. ..... 221/274; 221/250; 221/270
(58) Field of Search ..... 221/251, 268, 221/270, 274

(56) References Cited

U.S. PATENT DOCUMENTS 2,956,660 A * 10/1960 Nordquist ..... 194/346
4,074,829 A * 2/1978 Lee ..... 221/238
4,151,930 A * 5/1979 Baker et al. ..... 221/129
4,423,828 A * 1/1984 Tanaka et al. ..... 221/129
4,917,264 A 4/1990 Gasiel et al.
5,048,720 A * 9/1991 Hoke ..... 221/198
5,497,905 A 3/1996 Vogelpohl et al.
6,082,578 A * 7/2000 Miyoshi et al. ..... 221/124
6,098,841 A * 8/2000 Katakai ..... 221/251
6,112,943 A 9/2000 Lauer
6,241,121 B1 * 6/2001 Yasaka ..... 221/226

FOREIGN PATENT DOCUMENTS

JP 5-197877 8/1993

* cited by examiner

*Primary Examiner*—Donald P. Walsh
*Assistant Examiner*—Joseph Rodriguez
(74) *Attorney, Agent, or Firm*—Diederiks & Whitelaw, PLC

(57) ABSTRACT

A release mechanism for a vending machine includes a frame for supporting a plurality of hinged plates which are movable between article retention and dispensing positions. As the release mechanism is moved to the dispensing position, a sub-plate member of one of the plurality of plates projects into a dispensing path and abuts an article to be dispensed to force the article along the dispensing path. A pusher link is used to shift the sub-plate member, with the pusher link being adapted to extend through a central opening provided in a main plate member when the release mechanism assumes the article dispensing position.

32 Claims, 6 Drawing Sheets

ARTICLE RELEASE MECHANISM FOR A VENDING MACHINE

BACKGROUND OF THE INVENTION

1. Field of the Invention

The present invention pertains to the art of vending machines and, more particularly, to a release mechanism used in dispensing articles from a vending machine.

2. Discussion of the Prior Art

Vending machines are widely used to store and dispense a large variety of beverages and other articles. In certain types of vending machines, an item to be dispensed is supported upon a sloping surface and, upon selecting the item for dispensing, a release mechanism is employed to direct the item towards a dispensing zone of the machine. FIG. 1 of the present application is a partial view of an exemplary, known vending machine 2 used in dispensing articles 4, such as beverage bottles. In general, vending machine 2 includes a refrigerated cabinet 8 provided with a door 12 which can be pivoted about hinges, one of which is shown at 15. Behind door 12 are arranged a plurality of vertically spaced shelves or trays 20 for supporting articles 4 behind an overall release mechanism 25.

Each release mechanism 25 includes at least one set of hinged plates, generally indicated in FIGS. 2 and 3 at 30. As shown, set 30 is composed of plates 34–37 which are pivotally connected by means of elongated hinge pins 45–50 to respective ones of a casing or frame 52, another plate 34–37 or one of a pair of spaced, slidable connectors 55, 56. Connectors 55 and 56 are guided for movement relative to frame 52 during a vending operation through a driving force applied to an extension 65 of hinge pin 47, while being biased to the position shown in FIG. 2 by means of a spring 70. In this figure, plates 34 and 35 project out of the page, while the remainder of plates 36 and 37, along with connectors 55 and 56, extend in a substantially common plane within which connectors 55 and 56 slide. During a dispensing operation, plates 36 and 37 are shifted into the common plane with the connectors 55 and 56, while plates 36 and 37 project out of the page as shown in FIG. 3.

As indicated above, the overall vending machine article dispensing arrangement described to this point is known in the art and is actually described in U.S. Pat. No. 5,497,905, the disclosure of which is incorporated herein by reference. However, FIGS. 2 and 3 also illustrate an additional feature used in known vending machines of this type. That is, the desire to enhance the dispensing of articles 4 has been recognized. To this end, it has been proposed to provide a pusher or kicker element in the form of a spring 75 as part of the overall release mechanism 25. More particularly, spring 75 has a first end portion 77 coiled about hinge pin 50, an intermediate portion 78 wrapped about hinge pin 49, and an angled, second end portion 80. When the release mechanism is in the article retention position of FIG. 2, second end portion 80 is essentially pressed against plate 36. As the release mechanism 25 is shifted to the article dispensing position of FIG. 3, spring 75 pivots about an axis defined by hinge pin 50 such that second end portion 80 moves away from frame 52. This motion functions to aid in dispensing an article 4, with second end portion 80 of spring 75 engaging and pushing the article 4 along a dispensing path.

Although this spring arrangement enhances the dispensing operation, there is limited contact between spring 75 and the respective article 4. In addition, since the distance between the second end portion 80 and hinge pin 49 is fixed, the ability of the kicker arrangement to force an article 4 along a dispensing path is quite limited. Furthermore, it has been found that this prior kicker arrangement does not lend itself for use with dispensing a very wide variety of articles that range in size and shape. Therefore, for at least these reasons, there exists a need for an improved dispensing system for a vending machine. More particularly, there exists a need for a release mechanism which will enhance the dispensing of articles from a vending machine.

SUMMARY OF THE INVENTION

The present invention is directed to a release mechanism for use in dispensing articles from a vending machine. More particularly, the release mechanism includes a set of hinged plates which are guided for movement relative to an overall frame between article retention and article dispensing positions, wherein at least one of the hinge plates includes a main plate member and a sub-plate member, with the sub-plate member being pivotable relative to the main plate member during a dispensing operation.

In use, the sub-plate member is initially arranged upon or within the confines of the main plate member such that the main plate and sub-plate members are generally arranged in a common plane. However, when an article is selected for dispensing, the sub-plate member is caused to pivot relative to the main plate member. In general, the sub-plate member projects forward of the main plate member. In any event, this relative pivoting enables the sub-plate member to engage the article to be dispensed and functions to force the article along a dispensing path. In this sense, the sub-plate member acts as a pusher or kicker element which enhances the overall dispensing operation.

The sub-plate member is interconnected to a pusher link which actually causes the sub-plate member to pivot when the set of hinged plates are shifted during a dispensing operation. In accordance with the most preferred embodiment of the invention, the sub-plate member is formed with a slot through which a first end of the pusher link extends. A second end of the pusher link is rotatably attached to a hinge pin associated with an adjacent hinge plate. With this arrangement, when the set of hinged plates are shifted during a dispensing operation, the first end of the pusher link will initially shift within the slot. When the end of the slot is reached, the pusher link will force the sub-plate member to pivot, relative to the main plate member, into the dispensing path. In this manner, the sub-plate member abuts an article to force the article to move along the dispensing path. In general, the overall configuration and operation of the release mechanism enables the dispensing of a wide range of articles in an efficient and effective manner.

Additional objects, features and advantages of the present invention will become more readily apparent from the following detailed description of a preferred embodiment when taken in conjunction with the drawings wherein like reference numerals referring to corresponding parts in the several views.

DETAILED DESCRIPTION OF THE PREFERRED EMBODIMENT

Figure 1:
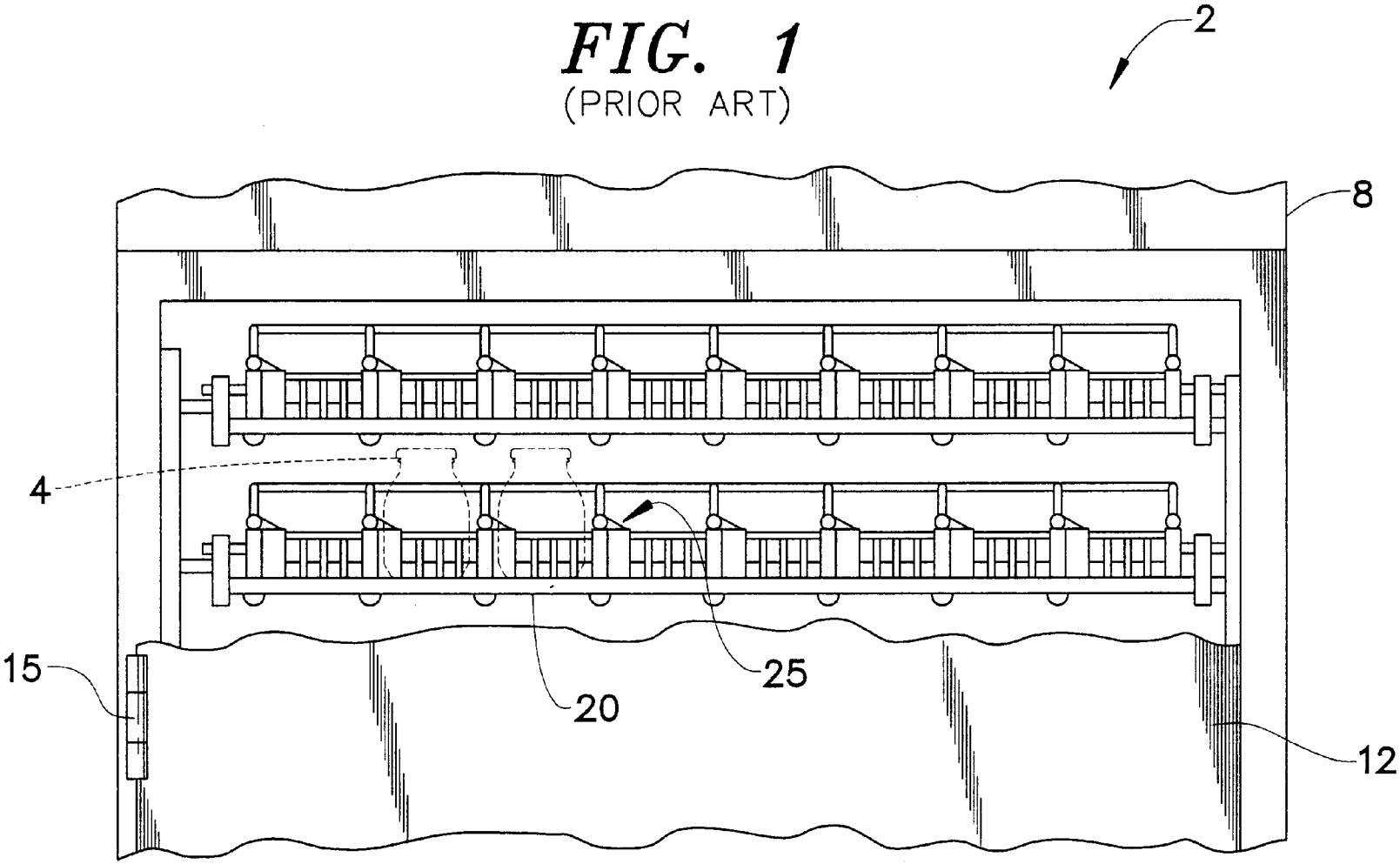
FIG. 1 (PRIOR ART)
FIG. 1 is a partial perspective view of a vending machine constructed in accordance with the known prior art.
Figure 2:
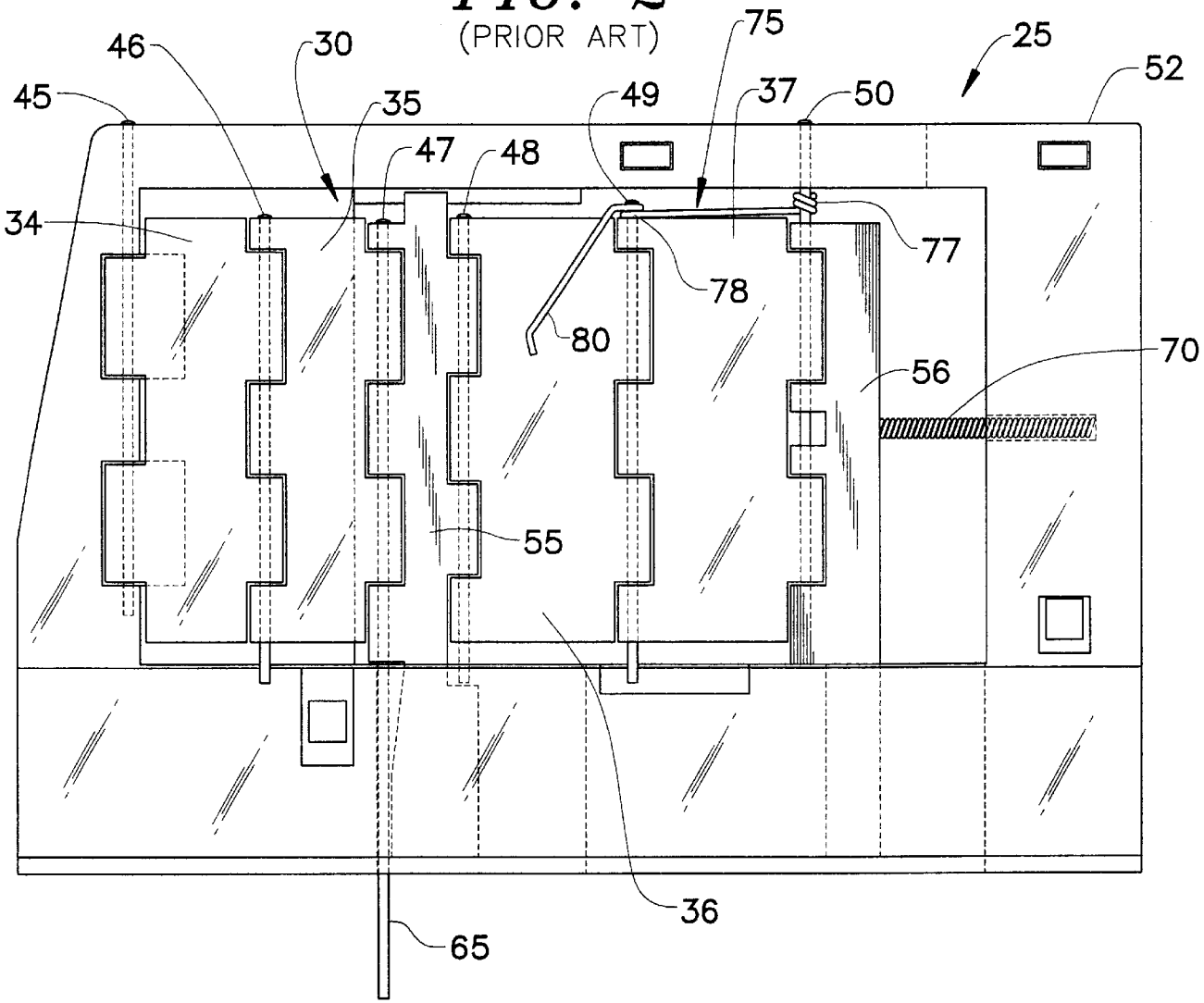
FIG. 2 (PRIOR ART)
FIG. 2 is an elevational view of a release mechanism incorporated in the prior art vending machine of FIG. 1, with the release mechanism shown in an article retention position.
Figure 3:
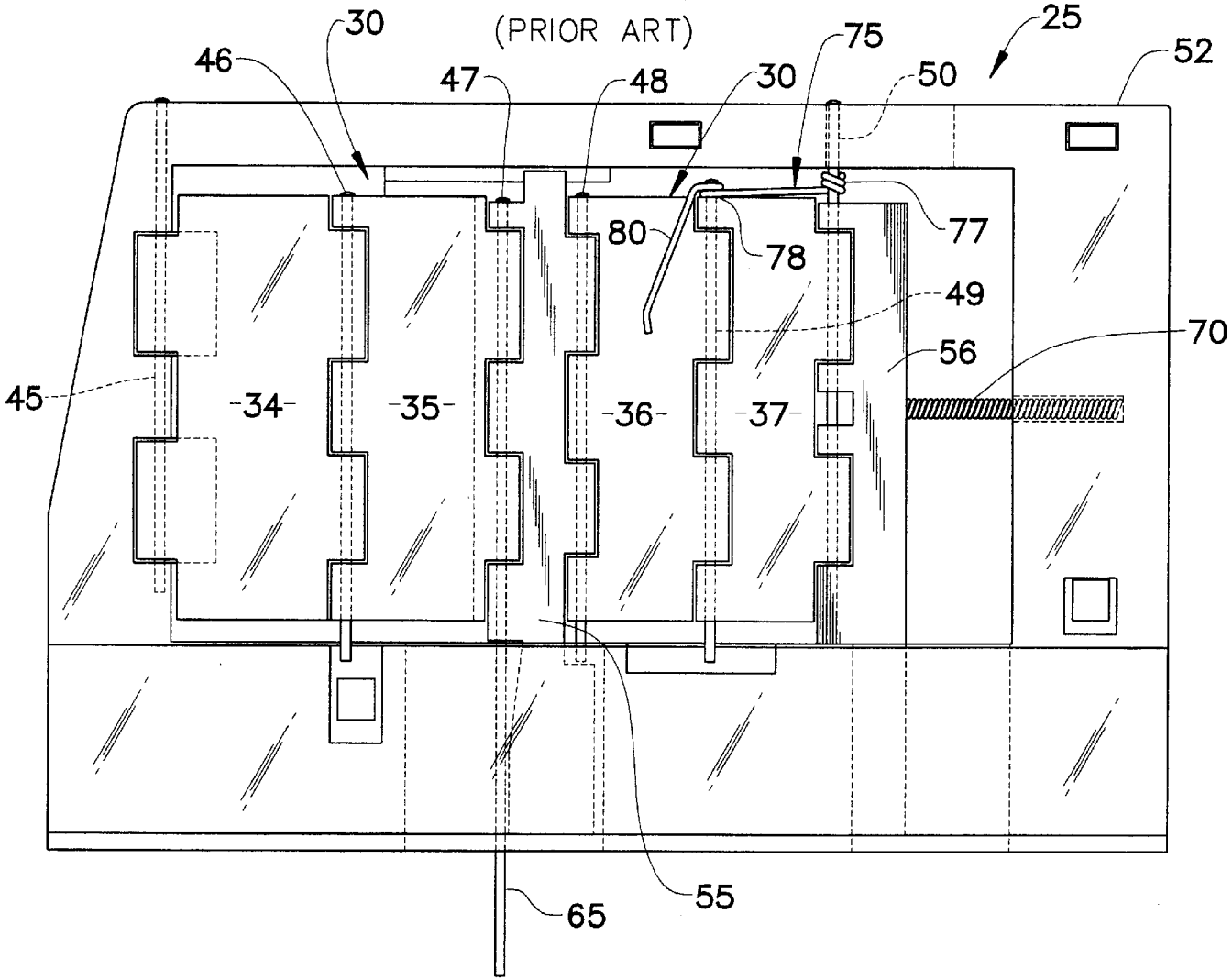
FIG. 3 (PRIOR ART)
FIG. 3 is a view, similar to that of FIG. 2, showing the release mechanism according to the prior art in an article dispensing position.

As discussed above, FIGS. 1–3 illustrate a known release mechanism arrangement for a vending machine, wherein the basic release mechanism structure is fully described in U.S. Pat. No. 5,497,905, the disclosure of which is incorporated herein by reference. As will be fully evident below, a majority of the basic structure of the release mechanism 100 shown in FIGS. 4A–5B finds correspondence in the known prior art arrangement. However, for the sake of completeness, the overall structure will be described below, with emphasis on the structural changes which define the present invention.

As shown, release mechanism 100 generally includes a set of hinged plates 130 which is composed of plates 134–137, elongated hinge pins 145–150, frame 152, slidable connectors 155 and 156, and a spring 170. More specifically, hinge plate 134 includes tab portions 175 and 176 which have aligned bores 178 and 179. Hinge pin 145 extends through a bore 182, which has upper, intermediate and lower sections 184–186, formed in frame 152, as well as bores 178 and 179 in tab portions 175 and 176 of hinge plate 134. Hinge pin 145 has a slightly enlarged head 189 which abuts frame 152. In this fashion, hinge plate 134 can pivot relative to frame 152. In the most preferred form, hinge pin 145 is tightly received in bore 182 and has a slightly greater tolerance with bores 178 and 179 such that hinge pin 145 does not rotate upon pivoting of plate 134.

Hinge plate 134 is also pivotally attached to hinge plate 135, with hinge pin 146 extending through aligned bores (not separately labeled) formed in tab portions 190 and 191 of hinge plate 134 and tab portions 192–194 of hinge plate 135. Hinge plate 135 is also pivotally attached to slidable connector 155, with hinge pin 147 extending through aligned bores formed in tab portions 198 and 199 of hinge plate 135 and tab portions 201–203 of connector 155. Connector 155 includes an upper projecting portion 210 and a lower projecting portion 211. Upper projecting portion 210 is adapted to slide along a flange 215 of frame 152, while lower projecting portion 211 is shiftably arranged within an open-ended elongated slot 220 defined in frame 152. Hinge pin 147 includes an extension 225 which actually extends entirely through slot 220. In this fashion, connector 155 is guided for sliding movement relative to frame 152 and a dispensing mechanism (not shown) can act upon extension 225 to reposition release mechanism 100 during a dispensing operation as will be discussed more fully below.

The present invention is particularly concerned with the construction and operation of hinge plate 136 in the overall release mechanism 100. In general, hinge plate 136 includes a main plate member 250 and a sub-plate member 255. Main plate member 250 is pivotally attached to connector 155 by means of hinge pin 148 extending through tab portions 257 and 258 of main plate member 250, as well as tab portions 260 and 261 of connector 155. In a manner similar to hinge pin 147 and lower projecting portion 211 of connector 155, a lower end 267 of hinge pin 148 is received in slot 220. At the same time, sub-plate member 255 is pivotal about an axis defined by hinge pin 148 since hinge pin 148 also extends through a tab portion 272 of sub-plate member 255. With this arrangement, sub-plate member 255 can also pivot relative to main plate member 250 during a dispensing operation as will be more fully discussed below.

Figure 4A:
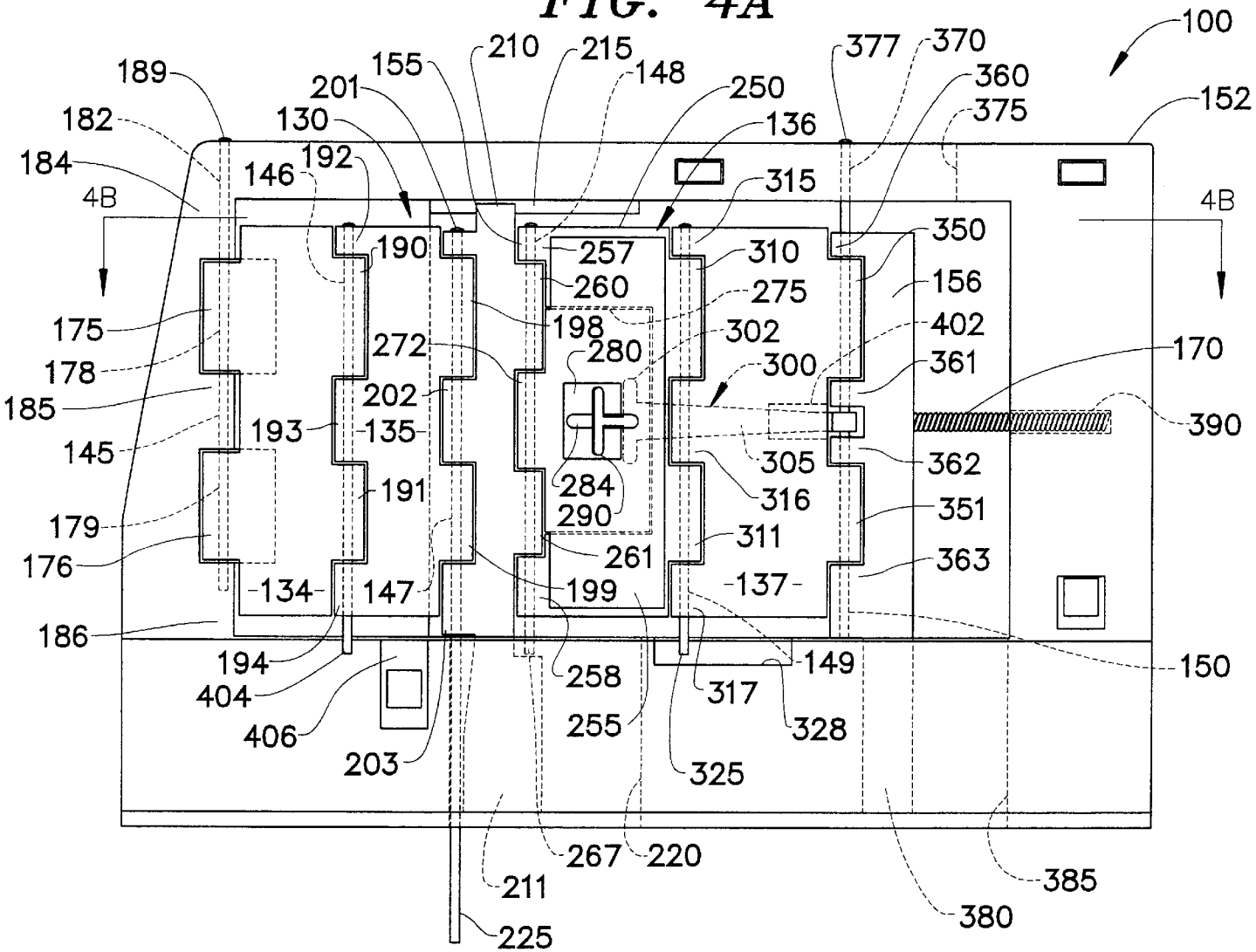
FIG. 4A is an elevational view of a vending machine release mechanism constructed in accordance with the present invention shown in an article retention position.
Figure 4B:
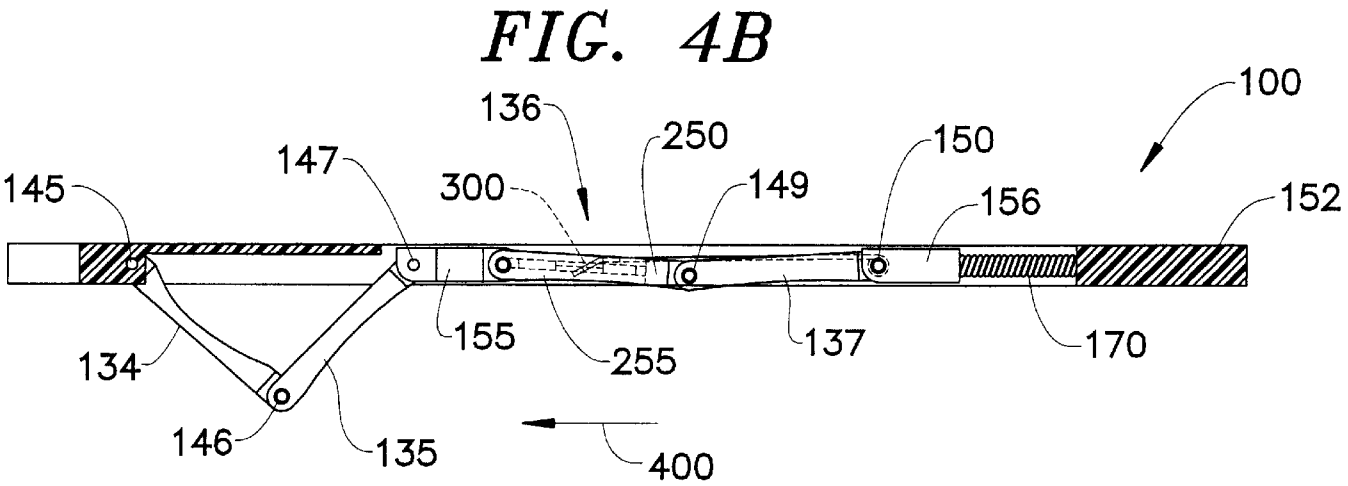
FIG. 4B represents a cross-sectional view of the release mechanism of the invention as taken along line 4B—4B in FIG. 4A.

Main plate member 250 includes a central cut-out or open region 275 into which is arranged a thickened central portion 276 (see FIG. 5B) of sub-plate member 255 when release mechanism 100 assumes the article retention position shown in each of FIGS. 4A and 4B. Sub-plate member 255 also includes an exposed recess 280 having a fore-to-aft extending slot 284 formed therein. A terminal cross leg 290 of a pusher link 300 projects through slot 284, while a second cross leg 302 is arranged on the other side of slot 284. A tapering main leg 305 of pusher link 300 extends and is rotatably attached to hinge pin 150.

Main plate member 250 is also pivotally connected to hinge plate 137 through hinge pin 149. More specifically, hinge pin 149 extends through respective bores (not labeled) formed in tab portions 310 and 311 of main plate member 250 and tab portions 315–317 of hinge plate 137. A terminal end 325 of hinge pin 148 is shown to abut a recessed section 328 of frame 152 to limit the movement of hinge plates 136 and 137 into the page as shown in FIG. 4A. Hinge plate 137 also has tab portions 350 and 351 through which hinge pin 150 extends. Hinge pin 150 also extends through tab portions 360–363 of connector 156 to pivotally attach hinge plate 137 to connector 156. Furthermore, an upper section 370 of hinge pin 150 is arranged within an elongated guide slot 375 formed in frame 152. In a manner analogous to head 189, hinge pin 150 also has an enlarged head 377. Actually, hinge pins 146–149 preferably include enlarged heads (shown but not separately labeled) as well.

Connector 156 includes a lower projecting portion 380 slidably arranged in an elongated slot 385 formed in frame 152. Connector 156 is biased in a forward direction (left in FIGS. 4A–5B) be means of spring 170. Although not clearly shown, connector 156 has projecting therefrom a rear shaft about which spring 170 is arranged. The shaft extends a short distance into a longitudinal bore 390 formed in frame 152, while spring 170 extends all the way into bore 390. In general, the shaft provides desired directional stability to this overall biasing arrangement.

With this construction, release mechanism 100 assumes the position shown in FIGS. 4A and 4B prior to an actual dispensing operation, i.e., in an article retention position. As shown in these figures, plates 136 and 137 extend in a substantially common plane with connectors 155 and 156, as well as frame 152. Sub-plate member 255 is actually recessed in main plate member 250 as clearly illustrated in these figures. On the other hand, plates 134 and 135 project away from frame 152 and into a dispensing path referenced by arrow 400. When in this article retention position, an article to be dispensed, such as a bottle which is not shown in these figures for the sake of clarity, abuts against plate 135 so as to be prevented or blocked from moving along dispensing path 400. Correspondingly, an additional article would be backed-up along dispensing path 400. In accordance with the invention, it is particularly important to note that pusher link 300 retains sub-plate member 255 against and within the confines of main plate member 250. To enhance this positioning, plate 137 is provided with a grooved section 402 into which pusher link 300 extends.

Figure 5B:
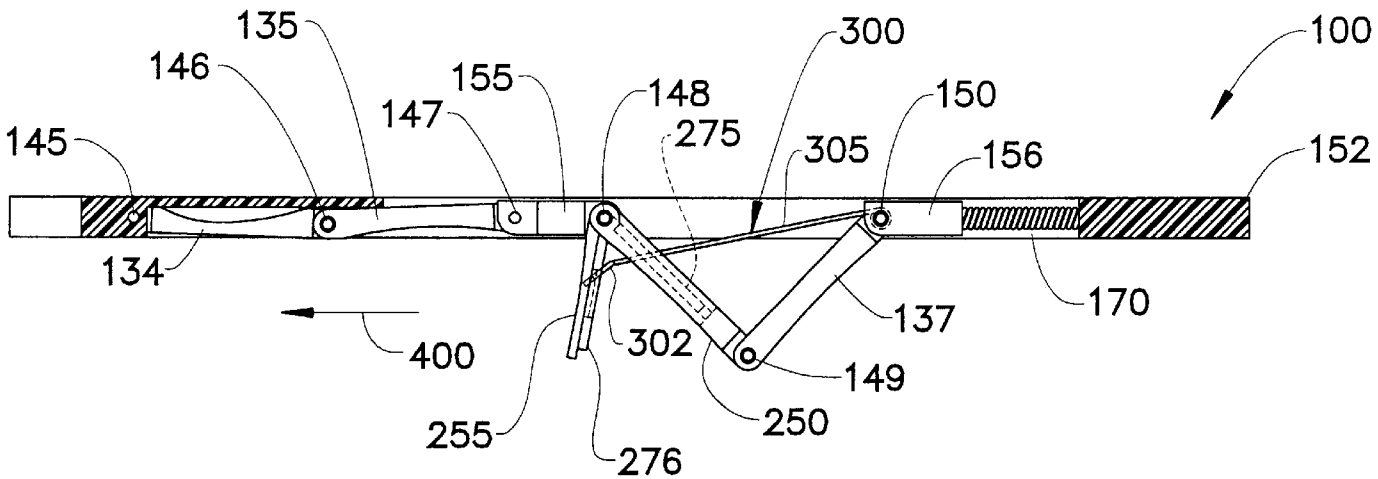
FIG. 5B is a cross-sectional view of the release mechanism of the present invention as taken along line 5B—5B in FIG. 5A.
Figure 5A:
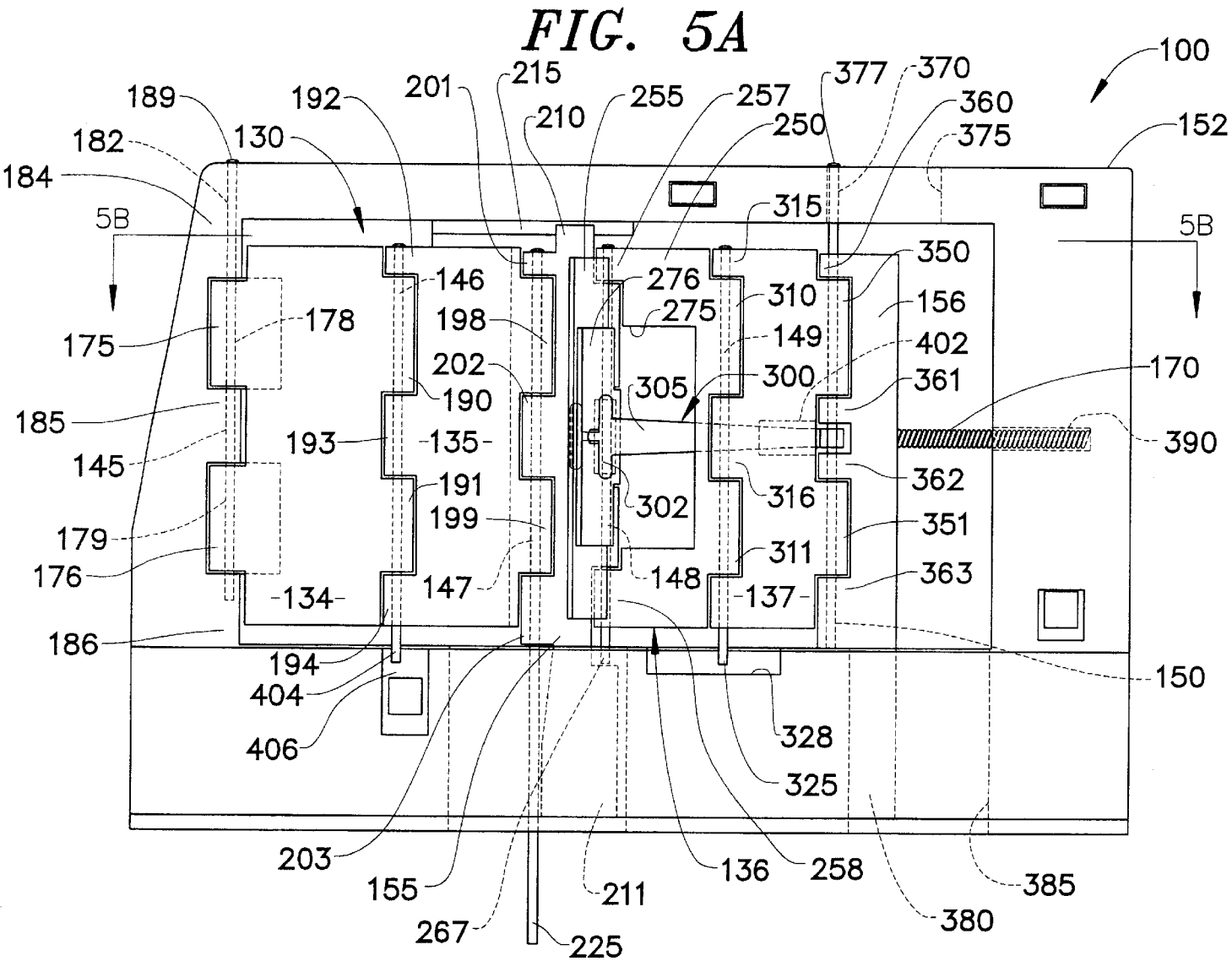
FIG. 5A is an elevational view of the present release mechanism shown in an article dispensing position.

When a proper vending sequence occurs, a mechanism (not shown) functions to shift release mechanism 100 from the article retention position shown in FIGS. 4A and 4B to the article dispensing position shown in FIGS. 5A and 5B through extension 225 of hinge pin 147. Since hinge pins 147 and 148, as well as connector 155, are supported for linear sliding movement relative to frame 152, shifting of release mechanism 100 causes plates 134 and 135 to shift towards frame 152, while plates 136 and 137 shift away from frame 152. During this sequence, pusher link 300 initially shifts within slot 284 of sub-plate member 255. Thereafter, continued shifting of connector 156 causes sub-plate member 255 to pivot relative to main plate member 250, with the fixed length pusher link 300 projecting through open region 275 of main plate member 250. Therefore, as plates 134 and 135 shift into the plane generally defined by frame 152, with an extension 404 of hinge pin 146 being received in a recess 406 of frame 152, in order to remove the obstruction defined by plates 134 and 135 which prevented the article from moving further along dispensing path 400, sub-plate member 255 will actually be caused to pivot forward so as to engage and push or "kick" the article along dispensing path 400. In accordance with the most preferred embodiment of the invention, sub-plate member 255 pivots through greater than ninety degrees (90°) relative to frame 152 from the article retention position of FIGS. 4A and 4B to the article dispensing position of FIGS. 5A and 5B.

Given the fact that sub-plate member 255 defines an enlarged abutment area, release mechanism 100 of the present invention is more effective in assuring a proper article discharge versus release mechanism 2 of the prior art. In addition, this construction enables release mechanism 100 to be used with a wider range of articles. In any event, although described with reference to a preferred embodiment of the invention, it should be readily understood that various changes and/or modifications can be made to the invention without departing from the spirit thereof. In general, the invention is only intended to be limited by the scope of the following claims.

I claim:

1. A vending machine for storing articles to be selectively dispensed comprising:

a cabinet;

at least one tray mounted in the cabinet for slidably supporting articles to be dispensed along a dispensing path; and a release mechanism positioned along the dispensing path, said release mechanism including a frame supporting a plurality of hinged plates for movement into and out of the dispensing path between article retention and article dispensing positions, one of said plurality of plates including a main plate member and a sub-plate member which is mounted for pivotal movement relative to the main plate member, said sub-plate member being adapted to project into the dispensing path to engage and force an article along the dispensing path during a dispensing operation.

2. The vending machine according to claim 1, wherein the sub-plate member is recessed within the main plate member when the plurality of hinged plates are in the article retention position.

3. The vending machine according to claim 1, wherein the release mechanism further includes a pusher link connected to the sub-plate member for pivoting the sub-plate member relative to the main plate member.

4. The vending machine according to claim 3, further comprising:

a slot formed in the sub-plate member, said pusher link being attached at the slot.

5. The vending machine according to claim 4, wherein the pusher link includes a first terminal end provided with a first cross member which extends through the slot.

6. The vending machine according to claim 5, wherein the pusher link further includes a second cross member provided on the first terminal end at a position spaced from the first cross member, said sub-plate member being positioned between the first and second cross members.

7. The vending machine according to claim 5, wherein the sub-plate member is formed with a recessed area, said slot being formed within the recessed area.

8. The vending machine according to claim 3, wherein said main plate member includes a central opening, said pusher link projecting through the central opening when the release mechanism is in the article dispensing position.

9. The vending machine according to claim 3, wherein the pusher link is rotatably mounted relative to the frame.

10. The vending machine according to claim 1, wherein the release mechanism further includes a plurality of hinge pins interconnecting respective ones of the frame and the plurality of plates, each of said main plate and sub-plate members being rotatable about a common axis defined by one of said plurality of hinge pins.

11. The vending machine according to claim 10, wherein the main plate member includes at least first and second, spaced tab portions and said sub-plate member includes an additional tab portion, said one of said plurality of hinge pins extending through the first, second and additional tab portions.

12. The vending machine according to claim 11, wherein the release mechanism further comprises: a connector slidably supported by the frame, said one of said plurality of hinge pins interconnecting the connector to each of the main plate and sub-plate members.

13. The vending machine according to claim 12, wherein the frame is formed with an elongated slot, said connector including a portion slidably supported within the elongated slot.

14. The vending machine according to claim 1, wherein the sub-plate member is pivoted, relative to the frame, through greater than ninety degrees from the article retention position to the article dispensing position.

15. A release mechanism for a vending machine having a dispensing path comprising:

a frame;

a plurality of hinged plates supported by the frame for movement into and out of the dispensing path between article retention and article dispensing positions, one of said plurality of plates including a main plate member and a sub-plate member which is mounted for pivotal movement relative to the main plate member, said sub-plate member being adapted to project into the dispensing path of a vending machine to engage and force an article along the dispensing path during a dispensing operation.

16. The release mechanism according to claim 15, wherein the sub-plate member is recessed within the main plate member when the plurality of hinged plates are in the article retention position.

17. The release mechanism according to claim 15, further comprising:

a pusher link connected to the sub-plate member for pivoting the sub-plate member relative to the main plate member.

18. The release mechanism according to claim 17, further comprising:

a slot formed in the sub-plate member, said pusher link being attached at the slot.

19. The release mechanism according to claim 18, wherein the pusher link includes a first terminal end provided with a first cross member which extends through the slot.

20. The release mechanism according to claim 19, wherein the pusher link further includes a second cross member provided on the first terminal end at a position spaced from the first cross member, said sub-plate member being positioned between the first and second cross members.

21. The release mechanism according to claim 19, wherein the sub-plate member is formed with a recessed area, said slot being formed within the recessed area.

22. The release mechanism according to claim 17, wherein said main plate member includes a central opening, said pusher link projecting through the central opening when the release mechanism is in the article dispensing position.

23. The release mechanism according to claim 17, wherein the pusher link is rotatably mounted relative to the frame.

24. The release mechanism according to claim 15, further comprising:

a plurality of hinge pins interconnecting respective ones of the frame and the plurality of plates, each of said main plate and sub-plate members being rotatable about a common axis defined by one of said plurality of hinge pins.

25. The release mechanism according to claim 24, wherein the main plate member includes at least first and second, spaced tab portions and said sub-plate member includes an additional tab portion, said one of said plurality of hinge pins extending through the first, second and additional tab portions.

26. The release mechanism according to claim 25, further comprising:

a connector slidably supported by the frame, said one of said plurality of hinge pins interconnecting the connector to each of the main plate and sub-plate members.

27. The release mechanism according to claim 26, wherein the frame is formed with an elongated slot, said connector including a portion slidably supported within the elongated slot.

28. The release mechanism according to claim 15, wherein the sub-plate member is pivoted, relative to the frame, through greater than ninety degrees from the article retention position to the article dispensing position.

29. A method of dispensing articles from a vending machine including a release mechanism defined by a plurality of hinged plates comprising:

positioning the plurality of hinged plates in an initial, article retention position wherein at least a first one of the hinged plates projects into a dispensing path to block an article from moving along the dispensing path; and shifting the plurality of hinged plates to an article dispensing position wherein the first one of the hinged plates is moved out of the dispensing path, while a portion of a second one of the hinged plates projects into the dispensing path and abuts the article to force the article along the dispensing path, wherein the second one of the hinged plates includes a main plate member and a sub-plate member, with the sub-plate member constituting the portion which projects into the dispensing path in the article dispensing position.

30. The method according to claim 29, further comprising:

shifting the sub-plate member through a pusher link as the plurality of hinged plates are shifted from the article retention position to the article dispensing position.

31. The method according to claim 30, further comprising:

positioning the sub-plate member against the main plate member when the release mechanism assumes the article retention position.

32. The method according to claim 29, further comprising:

pivoting the portion of the second one of the hinged plates through greater than ninety degrees, relative to a fixed frame of the release mechanism, as the release mechanism is shifted from the article retention position to the article dispensing position.

* * * * *